US007491136B2

(12) United States Patent
Deng et al.

(10) Patent No.: US 7,491,136 B2
(45) Date of Patent: Feb. 17, 2009

(54) LOW-DENSITY FEALMN ALLOY GOLF-CLUB HEADS AND GOLF CLUBS COMPRISING SAME

(75) Inventors: Xinhui Deng, Carlsbad, CA (US); Bing-Ling Chao, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 213 days.

(21) Appl. No.: 11/073,158

(22) Filed: Mar. 4, 2005

(65) Prior Publication Data

US 2006/0199661 A1 Sep. 7, 2006

(51) Int. Cl.
*A63B 53/04* (2006.01)

(52) U.S. Cl. ..... 473/349; 473/350

(58) Field of Classification Search ..... 473/324–350
See application file for complete search history.

(56) References Cited

U.S. PATENT DOCUMENTS

| | | | | |
|---|---|---|---|---|
| 2,931,098 | A | 4/1960 | Johnson, Jr. | |
| 3,193,384 | A | 7/1965 | Richardson | |
| 4,314,863 | A | 2/1982 | McCormick | |
| 4,968,357 | A | 11/1990 | Liu | |
| 5,167,733 | A | 12/1992 | Hsieh | |
| 5,419,560 | A * | 5/1995 | Bamber | 473/350 |
| 5,697,855 | A | 12/1997 | Aizawa | |
| 6,309,309 | B1 | 10/2001 | Beach et al. | |
| 6,520,868 | B2 | 2/2003 | Chen | |
| 6,617,050 | B2 | 9/2003 | Chao | |
| 6,685,577 | B1 | 2/2004 | Scruggs et al. | |
| 6,739,983 | B2 * | 5/2004 | Helmstetter et al. | 473/342 |
| 6,743,114 | B2 | 6/2004 | Best | |
| 6,743,118 | B1 * | 6/2004 | Soracco | 473/342 |
| 6,811,496 | B2 | 11/2004 | Wahl et al. | |
| 7,083,525 | B2 * | 8/2006 | Pond et al. | 473/251 |
| 2003/0082067 | A1 | 5/2003 | Chao | |
| 2004/0171434 | A1 | 9/2004 | Radcliffe et al. | |
| 2004/0192465 | A1 | 9/2004 | Erb et al. | |

OTHER PUBLICATIONS

Callister, Jr., William D. Materials Secience and Engineering: An Introduction, 4th Edition. New York: John Wiley & Sons, Inc., copyright 1997, p. 775.*

* cited by examiner

*Primary Examiner*—Alvin A. Hunter
(74) *Attorney, Agent, or Firm*—Klarquist Sparkman, LLP

(57) ABSTRACT

Golf clubs, clubheads for golf clubs, and methods for making clubheads are disclosed. An exemplary clubhead includes a rear component and a front component affixed to the rear component. The rear component is made at least partially of a FeAlMn alloy having a density in a range of 6.2 to 7.2 g/cm$^3$. The front component includes at least a portion of the face of the clubhead and is made of a material other than the FeAlMn alloy used to make the rear component. For example, the FeAlMn alloy contains (by weight) maximally 1% C, 27-32% Mn, 6-10% Al, 3-5% Cr, maximally 1% Si, and the balance being Fe. The reduced density of the rear component, compared to the density of conventional iron-type clubheads, provides more discretionary mass for manipulation in the clubhead, without sacrificing performance of the face of the clubhead.

28 Claims, 3 Drawing Sheets

LOW-DENSITY FEALMN ALLOY GOLF-CLUB HEADS AND GOLF CLUBS COMPRISING SAME

FIELD

This disclosure pertains to, inter alia, golf-clubs and golf-club heads ("clubheads"). More specifically, the disclosure pertains to clubheads of which at least a portion is fabricated of an alloy of iron (Fe), aluminum (Al), and manganese (Mn), such that the portion has a lower density than the density of steel alloys conventionally used for fabricating metal clubheads, thereby providing more latitude for discretionary placement of mass in the clubhead.

BACKGROUND

A set of golf clubs includes various types of clubs for use in different respective conditions or circumstances in which the ball must be hit during a golf game. An example set of clubs includes a "driver" for hitting the ball the longest distance on a course, several fairway "woods" for hitting the ball shorter distances than the driver, a set of irons (including one or more "wedges") for hitting the ball a range of distances that are typically shorter than produced when hitting the ball using a wood, and at least one putter. The term "wood" is based on tradition because such clubs originally were made of wood, but modern clubs of this type are usually made of metal and/or composite materials. The term "iron" also is based on tradition because such clubs originally were made of iron, but modern irons are usually made of steel, other metals, and/or composite materials.

Irons and putters characteristically have a flat (planar) face, wherein the "face" or "striking face" is the surface that normally contacts the ball whenever the ball is being hit with the club. A full set of irons provides lofts ranging from about 18 degrees to about 60 degrees. "Loft" is discussed later below.

A golf club comprises a head (also called a "clubhead"), a shaft affixed to the clubhead, and a grip affixed to the shaft. An exemplary head for an iron 10 is shown in FIG. 3, and includes a face 12, a sole 14, a toe 16, a heel 18, a back 20, a top line 22, and a hosel 24. The sole 14 usually is cambered or otherwise shaped to facilitate a desired interaction between the clubhead and the ground during a swing. The hosel 24 receives the distal terminus of the shaft 26 of the golf club and is the means by which the head 10 is fastened to the shaft 26. The angle of the hosel 24 to the rest of the head 10 is the "lie" of the head 10; during manufacture of irons, the hosel 24 can be manipulated slightly to change the lie to compensate for a golfer's physical characteristics. The face 12 of an iron typically is "offset," wherein offset is a distance from the front-most part of the hosel 24 to the front-most part, or leading edge, of the head 10. The face 12 typically has a series of score lines (grooves) 28 extending substantially horizontally across the face 12. The particular depth and dimensions of the score lines 28 are regulated by United States Golf Association (USGA) rules because the score lines contribute to the launch conditions of a ball struck off the face 12.

"Loft" is a measurement, in degrees, of the angle at which the face 12 of the clubhead 10 lies relative to a perfectly vertical plane. Through a typical set of irons from the "longest" to the "shortest" iron, the faces of the clubheads have progressively greater loft, which means that the faces are tilted progressively more from vertical. Loft affects the launch angle, backspin, and velocity of a struck ball. Striking a ball with a short iron will typically result in a struck ball having a higher launch angle and greater backspin as compared to a ball struck with a long iron. Consequently, the trajectory of a ball struck with a short iron will typically be higher and shorter than the trajectory of a ball struck with a long iron. To aid the golfer, the irons are numbered to codify the loft; the higher the number, the greater the loft. Generally, the greater the loft, the larger the surface area of the face 12.

Hitting the ball at any location on the face 12 of an iron (or any golf club) does not yield the same result. Every club has a "sweet spot" (a zone located roughly in a central region of the face) that represents the best hitting zone on the face 12 for maximizing the probability of the golfer achieving the best and most predictable shot using the particular club. The sweet spot generally is centered about the center of gravity (CG) of the clubhead, and the smaller the surface area of the face, the smaller the area of the sweet spot. While swinging the club at a ball, the golfer strives to hit the ball inside the sweet spot in a consistent manner so as to provide the greatest probability that the ball will travel in the manner intended by the golfer.

The preferred sizes and masses of the heads of irons have been established by long experience with the playability of iron clubheads. As a result, especially for tournament play, the clubhead of each iron has a characteristic size, shape, and weight. To achieve a desired swing-weight for each club, head-weight standards have been established for each iron. Consequently, someone striving to improve the performance or other characteristic of an iron must work within certain limitations of size and mass. One way in which manufacturers have striven to improve the performance of many golfers using an iron is to increase the size (surface area) of the club's sweet spot without significantly enlarging the face. By using an iron having a larger sweet spot, the golfer can achieve more consistent results shot-to-shot using the club, even if the club does not strike the ball at exactly the same location on the face each time. In other words, a larger sweet spot generally makes the iron more "forgiving" of a golfer's variability in swinging the club and striking the ball with it, thus providing the golfer with a greater assurance of making the intended shot.

Another way of making a club, such as an iron, more forgiving is to increase the moment of inertia (MOI) about the CG of the clubhead, where the CG is the point within the head at which the head is perfectly balanced. MOI is a measure of the head's resistance to a twisting motion caused by striking the ball. For example, if a golfer's swing is off and the ball is struck on the toe of the head, an iron having a higher MOI will exhibit more resistance to twisting caused by the faulty hit, and thus will provide the golfer with a greater probability that the ball will follow the desired flight path.

In view of the size and mass limitations of clubheads, one relatively recent way in which golf-club manufacturers have increased the size of the sweet spot in irons is by removing material from behind the face. These methods tend to reduce the thickness, and thus the mass, of the face, which allows a corresponding redistribution of mass to perimeter regions of the head (called "perimeter weighting"). Perimeter weighting results in a larger percentage of the total mass of the clubhead being situated behind and proximate the perimeter of the face compared to a traditional blade-type iron. This leaves a cavity in regions immediately behind the face, and an iron clubhead having this configuration is designated a "cavity back" iron. Perimeter weighting generally increases the MOI about the CG of the clubhead, resulting in less twisting of the head during off-center hits. An iron with perimeter weighting is typically more forgiving of off-center hits and provides more consistent distance and directional control of a struck ball, resulting in more accurate shots.

Perimeter weighting may also provide latitude for optimal placement of the CG of the clubhead. For most golfers, it is advantageous to place the CG as low in the head as possible to give the struck ball a high launch angle so as to achieve the intended airborne trajectory, and perimeter weighting can facilitate lowering of the CG. Alternatively, the CG can be raised to enable the iron to produce a ball trajectory in which the ball leaves the face at a lower launch angle. Usually, less proficient golfers advantageously use a club having a lower CG, especially when using a long iron.

The "feel" of a golf club embodies characteristics such as sound and vibration transmitted to the golfer as he swings the club and strikes the ball with the club. Feel provides the golfer with various acoustic, tactile, mental, and other feedback from which the golfer can assess performance, game satisfaction, and other criteria closely associated with the golfing experience. The experienced golfer is well acquainted with various stings, shocks, and other types of vibrations transmitted up the shaft from the clubhead that allow the golfer to determine instantaneously whether the ball has been hit within the sweet spot. Manipulating the mass distribution within an iron clubhead can open up possibilities for reducing or dampening stings, shocks, and other undesired vibrations, and thereby enhancing the tactile and acoustic experience associated with making the shot.

The coefficient of restitution (COR) of a clubhead is a measure of the ability of the face of a club to exhibit a springiness or rebound effect that can give the struck ball a bit of an extra push as it leaves the face. The COR effect depends upon the ability of the face to deflect and rebound elastically when the struck ball is still in contact with the face of the club. The maximum COR that can be exhibited by a club is limited by USGA rules.

Particularly with the recent upsurge in popularity of golf, club manufacturers strive ever harder to design clubs that are configured so as to address individual golfers' abilities, strengths, weaknesses, peculiarities of swing, and other factors to provide more (and a greater variety of) golfers with better prospects for an improved and more enjoyable golf game. To this end, a wide variety of club configurations are available, especially of clubs that embody various approaches to manipulating the mass, CG, MOI, COR, feel, and other parameters of the clubheads. In irons, the current latitude for such shifts is dictated largely by the respective densities of available suitable materials from which the heads can be made. Generally, the greater the density of the material, the less the available latitude for shifting of mass distribution and of CG.

Irons traditionally (and mostly still) are made of steel (an iron alloy), such as carbon steel, low-alloy steel, or stainless steel. These steels have a density in the range of 7.7 to 7.9 g/cm$^3$ and have sufficiently high strength for use in irons. Unfortunately, the high density of this material imposes limits on various approaches to performance enhancement. For example, designs for conventional, mass-producible clubs made of steel are limited as to how far down and back the CG can be placed. Manufacturers also have tried various iron designs in which the clubhead is made substantially of steel, but with only the face (strike plate) made of a less dense material such as titanium. Unfortunately, many golfers believe that irons having such a configuration exhibit objectionable "feel" and/or have any of various other shortcomings. Other manufacturers have tried making the entire clubhead of a less dense material such as titanium, aluminum, or composite materials. Unfortunately, these alternative materials usually lack sufficient strength for use in irons, exhibit undesirable COR characteristics, have objectionable feel, require weighting plugs or inserts to achieve a desired mass, are expensive to manufacture, and/or suffer from some other shortcoming.

Many types of clubheads are made by a forging process. Forging worked well for earlier, more conventional, clubhead designs. However, forging oftentimes is incapable of producing complex clubhead geometries and configurations, such as cavity-back designs. Additionally, with the recent advent of more highly "engineered" clubheads, it now is desirable that the heads be formed to tighter tolerances than are possible using forging processes to minimize expensive downstream machining steps. As a result, club manufacturers have employed various casting methods, especially investment casting, with good results using the several high-density steel alloys commonly found in clubheads, particularly irons.

Various specific attempts at developing lower-density steel alloys and other materials for use in golf clubs are described in the following references. U.S. Pat. No. 6,685,577 to Scruggs discusses clubheads made of an amorphous metal containing 45-67 at % Zr+Ti (zirconium and titanium), 10-35 at % Be (beryllium), and 10-38 at % Cu+Ni (copper and nickel). U.S. Pat. No. 2,931,098 to Johnson discusses irons made of alloys consisting predominantly of Cu and either Zn (zinc) or Al (aluminum). U.S. Pat. No. 6,520,868 to Chen discusses clubheads made of a steel alloy containing (by weight) maximally 0.03% C (carbon), 0.2-0.6% Si (silicon), maximally 0.15% Mn (manganese), maximally 0.03% P (phosphorus), maximally 0.03% S (sulfur), 10.5-13.5% Cr (chromium), 0.8-1.4% Mo (molybdenum), 0.8-1.4% Ni, 0.02-0.1% Nb (niobium), maximally 0.01% N (nitrogen), maximally 0.03% Cu, and the balance being Fe. U.S. Pat. No. 4,314,863 to McCormick discusses clubheads made of a steel alloy containing (by weight) 13-20% Cr, 2.0-3.6% Ni, 2.0-3.5% Cu (with sum of Ni and Cu being at least 5.0%), 0.2-1.4% Mn, 0.5-1.0% Si, maximally 0.035% P, maximally 0.035% S, less than 0.10% niobium (Nb), less than 0.10% Al, 0.20-0.80% C (with maximally 0.05% N) or 0.10-0.60% C (with 0.05-0.10% N), and the balance being Fe. U.S. Patent Application Publication No. 2003/0082067 A1 to Chao discusses clubheads forged of an iron alloy containing (by weight) 28-31.5% Mn, 7.8-10.0% Al, 0.90-1.10% C, 0.35-2.5% Ti (titanium), and the balance being Fe. U.S. Pat. No. 6,617,050 to Chao discusses clubheads made of an alloy containing (by weight) 25-31% Mn, 6.3-7.8% Al, 0.65-0.85% C, 5.5-9.0% Cr, and the balance being Fe. U.S. Pat. No. 5,167,733 to Hsieh discusses clubheads (specifically drivers) made of an alloy containing (presumably by weight) 0.5-2.0% C, 25-35% Mn, 5-10% Al, 0.5-1.5% Mo, and the balance being Fe. In Hsieh, the alloy is used to fabricate, by casting, the entire head of the driver including the face, which necessitates making the head in two parts that must be welded together. Unfortunately, the performance and feel of such a head are not satisfactory for many players.

In view of the foregoing, there remains a need for further improvements in methods for making clubheads (especially irons) that have the desired latitude for mass distribution, CG shifting, and other configurational manipulations for achieving optimal performance and feel.

SUMMARY

The foregoing need is satisfied by apparatus and methods as disclosed herein, in which a first aspect is directed to golf-club heads ("clubheads") for golf clubs. An embodiment of such a clubhead comprises a rear component and a front component affixed (joined) to the rear component. The rear component is made at least partially of a FeAlMn alloy having a density in a range of 6.2 to 7.2 g/cm$^3$, more desirably in the range 6.2 to 6.9 g/cm$^3$. The front component comprises at least a portion of the face of the clubhead and is made of a material other than the FeAlMn alloy used to make the rear component. By way of example, in an embodiment, the FeAlMn alloy contains (by weight) maximally 1% C, 27-32% Mn, 6-10% Al, 3-5% Cr, maximally 1% Si, and the balance being Fe.

In another embodiment of a clubhead the rear component includes the back of the clubhead. Either the front component or the rear component can include the hosel. For example, the rear component can include the back and at least a respective portion of each of the sole, the top line, and the toe of the clubhead, and the front component can include at least the hosel and a portion of the heel. In yet another embodiment the front component consists essentially of a striking plate affixed to the rear component. The front component can be made of a metal selected from the group consisting of titanium alloys and steels. The steel can be, for example, a carbon steel, a Cr—Mo steel, a Ni—Cr—Mo steel, an austenitic stainless steel, a ferritic stainless steel, a martensitic stainless steel, or a PH (precipitation hardened) alloy.

In yet another embodiment the rear component is as summarized above and at least a portion of the front component is made of a material having a density in a range of 7.7 to 7.9 g/cm$^3$. Such a front component can be made of, for example, a titanium alloy or a steel. The steel can be, for example, any of the steels listed above.

In yet another embodiment the rear component is a casting made of the FeAlMn alloy. In this configuration at least a portion of the front component can be forged, rolled, or a casting, or a combination thereof.

The subject clubhead can be configured as the head of an iron or a putter. If configured as the clubhead of an iron, the clubhead can be configured as a blade-type iron, a hollow-back iron, or a cavity-back iron, for example. The rear component can include mass inserts (weighting elements) affixed thereto. At least one of the weighting elements can have a density greater than the density of the FeAlMn alloy. In yet another embodiment the front component can include weighting elements affixed thereto. At least one of the weighting elements can have a density greater than the density of the FeAlMn alloy.

In another embodiment at least a portion of the front component is comprised of a material such as a metal, a composite, a polymer, a ceramic, or a mixture or combination of any of these materials. For example the portion (if made of a metal) can be made of a steel, a titanium alloy, an aluminum alloy, a magnesium alloy, a copper alloy, a nickel alloy, an amorphous alloy, or a combination of any of these materials. If the portion is made of a composite, the composite can be, for example, a glass-fiber-reinforced polymer, a carbon-fiber-reinforced polymer, a ceramic-matrix composite, a metal-matrix composite, a natural composite, or a combination of any of these materials. If the portion is made of a polymer, the polymer can be, for example, a thermoplastic, a thermoset, a copolymer, an elastomer, or a combination of any of these materials. If the portion is made of a thermoplastic, the thermoplastic can be, for example, polyethylene, polypropylene, polystyrene, acrylic, PVC, ABS, polycarbonate, polyurethane, polyphenylene oxide, polyphenylene sulfide, nylon, an engineering thermoplastic, or a combination of any of these materials. If the portion is made of a thermoset, the thermoset can be, for example, a polyurethane, an epoxy, a polyester, or a combination of any of these materials. If the portion is made of a ceramic, the ceramic can be an oxide, a carbide, a nitride, or a combination of any of these materials. Exemplary oxides include any one or more of titanium oxide, aluminum oxide, magnesium oxide, and silicon dioxide. Exemplary carbides include any one or more of titanium carbide, tungsten carbide, silicon carbide, and boron hydride. An exemplary nitride is silicon nitride.

According to another aspect, a golf club is provided, of which the clubhead can be, for example, any of the clubheads summarized above attached to a shaft (including a grip). Such a golf club can be an iron or a putter, for example. The subject golf club can be in a set of golf clubs that includes at least one such golf club.

Yet another aspect is directed to clubheads having a rear component and a front component. In an embodiment the rear component is cast of a FeAlMn alloy containing (by weight) maximally 1% C, 27-32% Mn, 6-10% Al, 3-5% Cr, maximally 1% Si, and the balance being Fe, wherein the alloy has a density in a range from 6.2 to 6.9 g/cm$^3$. At least a portion of the front component has a density ranging from 7.7 to 7.9 g/cm$^3$. The front component is affixed to the rear component.

Yet another aspect is directed to a clubhead having a sole, a heel, a toe, and a hosel. An embodiment of such a clubhead comprises a rear component and a front component. The rear component includes the sole and is made at least partially of a FeAlMn alloy having a density in a range of 6.2 to 6.9 g/cm$^3$. The front component is affixed to the rear component and comprises the face of the clubhead. The front component has at least a portion thereof that has a density different from the density of the FeAlMn alloy. The rear component further comprises at least one unit of mass, serving as a weighting element and having a density greater than the density of the FeAlMn alloy, attached at or near the sole.

The foregoing and other features and advantages of the subject of this disclosure will be more readily apparent from the following detailed description, which proceeds with reference to the drawings.

BRIEF DESCRIPTION OF THE DRAWINGS

In FIG. 1C the rear component is shown detached from the front component of the clubhead, but it will be understood that the front component is joined to the rear component.

In FIGS. 2A and 2B the rear component is shown detached from the front component of the clubhead, but it will be understood that the front component is joined to the rear component.

DETAILED DESCRIPTION

Figure 1A:
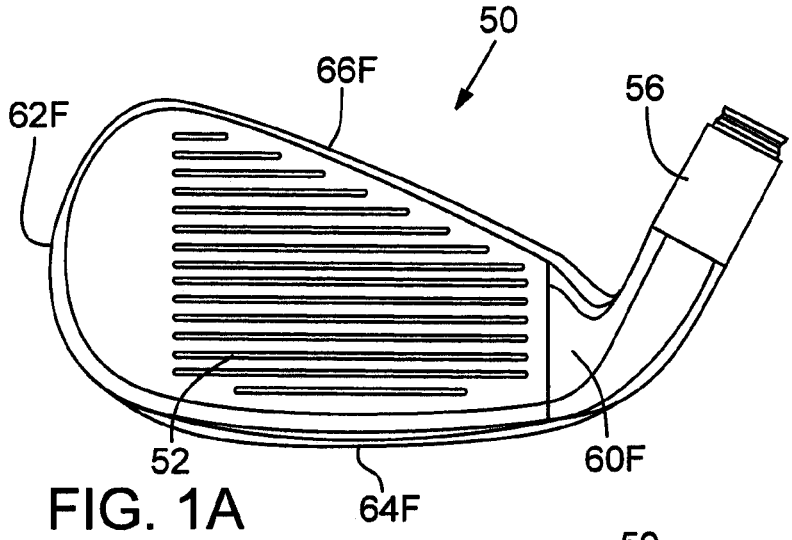
FIGS. 1A-1C are orthogonal views of an iron-type golf-club head ("clubhead") according to the first representative embodiment.

This disclosure is set forth in the context of representative embodiments that are not intended to be limiting in any way.

Low-Density Alloy

The "low-density alloy" or "FeAlMn alloy" as these terms are used herein generally contains (by weight) greater than 0% and maximally 1.2% C, 27-32% Mn, 6-10% Al, greater than 0% and maximally 5% Cr, greater than 0% and maximally 1% Si, and the balance being Fe. The density of the FeAlMn alloy is generally in the range of 6.2 to 7.2 g/cm$^3$, and more desirably in the range of 6.2 to 6.9 g/cm$^3$ (compare with densities of 7.7 to 7.9 g/cm$^3$ for steels conventionally used in iron-type clubheads). The high concentration of Al (having a density of 2.7 g/cm$^3$) is primarily responsible for reducing the density of the FeAlMn alloy, but the concentration of Mn (having a density of 7.44 g/cm$^3$) also contributes significantly to the reduced density of the FeAlMn alloy.

The low-density alloy exhibits a strength-to-density ratio of approximately $4.5\times10^5$ inches and an elastic strain limit of less than 1%. The low-density alloy has high strength (>100 ksi), high ductility (>15%), and good processability. Although the Cr content provides some corrosion resistance, for more satisfactory corrosion resistance, a clubhead or portion thereof made of the low-density alloy should be plated or otherwise rendered resistant to corrosion.

Use of the low-density alloy permits any of a variety of clubhead design improvements. For example, use of the low-density alloy enables the clubhead to be made larger than is typical to achieve enlargement of the sweet spot and to increase MOI. Alternatively, a clubhead can be made a standard size, thereby increasing discretionary weight and allowing for the use of one or more weighting elements used, e.g., for shifting the CG downward and back in the clubhead.

The low-density alloy is most conveniently prepared in a batch process by a metallurgical formulator that specializes in preparing, to a customer's specifications, ingots, pellets, or other units of specific alloys. Ingots are easy to transport to a casting facility.

General Configuration

The subject clubhead, similar to substantially all iron-type clubheads, includes a face, a sole, a toe, a heel, a face, a back, a top line, and a hosel. The clubhead comprises a rear component and a front component that are attached to each other. The rear component is cast from the low-density alloy (FeAlMn alloy). The rear component desirably (but not necessarily) occupies the larger volumetric proportion of the clubhead, compared to the front component. The rear component can include the hosel and one or more of the sole, toe, heel, back, or respective portions thereof, and even a portion of the face. The rear component additionally can include one or more weighting elements formed from one or more high-density materials (e.g., tungsten, lead, etc.) strategically placed so as to place the CG of the clubhead at the desired locus. The rear component also or alternatively can include one or more inserts or applied bodies as used for vibration control or damping, acoustic control or damping, COR manipulation, or the like. The rear component also can have any of various configurations. For example, the rear component may be configured as a blade-back iron such as the "rac MB" iron manufactured by Taylor Made Golf (Carlsbad, Calif.), or the rear component may be configured as a cavity-back iron such as any of the "rac" "CB," "HT," "LT," "OS," and "CGB" irons also manufactured by Taylor Made Golf.

The front component may include at least a portion of the face and at least a portion of at least one of the sole, heel, toe, top line, and hosel. Alternatively, the front component may include the entire face and at least a portion of at least one of the sole, heel, toe, top line, and hosel. The front component can be limited, at a minimum, to a strike plate mounted so as to define the face of the clubhead. In addition, the front component can include one or more cartridges, weighting elements, and/or inserts or applied bodies as used for CG placement, vibration control or damping, acoustic control or damping, COR manipulation, or the like.

The front component can be made of substantially any suitable material and by substantially any suitable process. For example, the front component can be made of a material having a greater density than the low-density alloy. Exemplary materials in this regard include, but are not limited to, carbon steels (e.g., 1020, 1030, 1040 carbon steels), chrome-molybdenum steels (e.g., 4140 Cr—Mo steel), Ni—Cr—Mo steels (e.g., 8620 Ni—Cr—Mo steel), austenitic stainless steels (e.g., 304, N50, N60 stainless steels), ferritic stainless steels (e.g., 430 stainless steel), martensitic stainless steels (e.g., 410 stainless steel), and precipitation hardened (PH) steel alloys (e.g., 17-4, C450, C455). These steels have respective densities generally in the range of 7.8±0.1 g/cm$^3$.

Alternatively, the front component can be made of a metal (other than the low-density alloy) having the same or a lesser density than the low-density alloy. Exemplary metals in this regard include, but are not limited to, titanium alloys (e.g., alpha/near alpha: 3-2.5; alpha-beta: 6-4; SP700; beta/near beta: 15-3-3-3, 10-2-3), aluminum alloys (e.g., 3000 series, 5000 series, 6000 series such as 6061-T6, and 7000 series such as 7075), magnesium alloys, copper alloys, nickel alloys, amorphous alloys, and combinations of these materials. Other candidate materials for use in making all or a portion of the front component include, but are not limited to, polymers, ceramics, and mixtures and combinations thereof. Exemplary polymers include, but are not limited to, thermoplastics, thermosets, copolymers, elastomers, and combinations of these materials. Of these polymers, exemplary thermoplastics include, but are not limited to, polyethylene, polypropylene, polystyrene, acrylic, PVC (polyvinylchloride), ABS (acrylonitrile-butadiene-styrene), polycarbonate, polyurethane, PPO (polyphenylene oxide), PPS (polyphenylene sulfide), nylon, any of various "engineering thermoplastics," and combinations of these materials. Exemplary thermosets include, but are not limited to, polyurethanes, epoxies, polyesters, and combinations thereof. Exemplary ceramics include, but are not limited to, oxides, carbides, and nitrides, and combinations of these materials. Exemplary oxide ceramics include, but are not limited to, aluminum oxide, zirconium oxide, titanium oxide, magnesium oxide, and silicon dioxide. Exemplary carbide ceramics include, but are not limited to, titanium carbide, tungsten carbide, silicon carbide, and boron hydride. An exemplary nitride ceramic is silicon nitride. All or a portion of the front component also can be made of a composite such as, but not limited to, a glass-fiber-reinforced polymer (GFRP), a carbon-fiber-reinforced polymer (CFRP), a metal-matrix composite (MMC), a ceramic-matrix composite (CMC), a natural composite (e.g., wood or a material comprising wood), or a combination of these materials. Further alternatively, the front component can be made of a material that is a combination of two or more of all these listed materials.

All or a portion of the front component can be made by a process such as casting, stamping, hot forging, cold forging, hot rolling, cold rolling, molding, machining, etching, or other suitable process, or combinations of these processes.

The front component is affixed to the rear component by any of various joining techniques, including (but not limited to) welding, brazing, adhesive bonding, mechanical joining (e.g., press fit or lip encasement), mechanical fasteners (e.g., rivets, screws, or analogous fasteners), thermal-diffusion pressing, explosive bonding, or any of various combinations of these methods.

As noted above, at least one of the front component and the rear component can include one or more attachments or inserts for the purpose of CG manipulation of the clubhead. For example, U.S. Pat. No. 6,811,496, incorporated herein by reference, discusses the attachment of mass-altering pins or cartridges ("weighting elements") that generally can be made of tungsten, nickel, aluminum, or stainless steel, for example, more desirably of a material having greater density than the material used to form the clubhead.

A clubhead as generally described above is made into a golf club by attaching, in any of various possible ways, a suitable shaft to the hosel. Various conventional methods for attaching a shaft to a hosel are known in the art. Also, various types of shafts are known and available, including non-metallic shafts. For comfortable use of the club, a grip is attached to the shaft.

Casting of the Low-Density Alloy

The rear component, made of the low-density alloy, desirably is fabricated by casting, preferably investment casting. Investment casting provides the tight tolerances and configurational detail desired when forming a clubhead, and thus minimizes downstream machining and finishing steps. It will be understood that any of various investment casting processes can be used. An exemplary investment casting process is performed as follows:

Injection molding is used to form sacrificial "initial" patterns (made of casting wax) of the desired castings. A suitable injection die can be made of aluminum or other low-melting alloy by a CAD-controlled machining process using a casting master. CNC (computer numerical control) machining desirably is used to form the intricacies of the mold cavity in the low-melting alloy. The cavity dimensions are established so as to compensate for linear and volumetric shrinkage of the casting wax encountered during casting of the initial pattern and also to compensate for any similar shrinkage phenomena expected to be encountered during actual metal casting performed later using a casting mold formed from the sacrificial patterns.

A group of the sacrificial patterns is assembled together and attached to a central wax sprue to form a casting cluster. Each sacrificial pattern of the casting cluster forms a respective mold cavity in the ceramic molding shell formed later around the casting cluster. The central wax sprue provides runner channels and gates for routing molten metal to individual mold cavities in the molding shell. The runner channels desirably include one or more filters (made, e.g., of ceramic) for enhancing smooth laminar flow of molten metal into and in the ceramic molding shell and for preventing entry of any dross that may be trapped in the mold into the mold cavities. The runner channels are configured so as to allow molten metal to fill the mold cavities from the bottom upward.

The ceramic molding shell is constructed by immersing the casting cluster into a liquid ceramic slurry, followed by immersion in a bed of refractory particles. This immersion sequence is repeated as required to form a sufficient wall thickness of ceramic material around the casting cluster, thereby forming a unitary casting shell. An exemplary immersion sequence includes six dips of the casting cluster in liquid ceramic slurry and five dips in the bed of refractory particles, yielding a casting shell comprising alternating layers of ceramic and refractory material. The first two layers of refractory material comprise fine (300 mesh) zirconium oxide particles, and the third to fifth layers of refractory material comprise coarser (200 mesh to 35 mesh) aluminum oxide particles. Each layer is dried under controlled temperature (25±5° C.) and relative humidity (50±5%) before applying the subsequent layer.

The ceramic molding shell is placed in a sealed steam autoclave in which the pressure is rapidly increased to 7-10 $kg/cm^2$. Under such a condition, the wax in the shell is melted out using injected steam. The shell is then baked in an oven in which the temperature is ramped up to 1000-1300° C. to remove residual wax and to increase the strength of the shell. The shell is now ready for use in casting clubhead parts of the low-density alloy.

In an induction furnace, the non-aluminum constituents of the low-density alloy are melted first, followed by a 30% reduction in furnace power. The aluminum constituent of the alloy is then added, followed by an increase in furnace power to 75%. Any accumulated slag on the surface of the melt is completely removed and the furnace temperature is increased. When the temperature of the melt reaches 1500-1680° C., the furnace is tilted to pour the melt by gravity into the heated shell. Pouring time is controlled so as to achieve complete filling of the shell in less than five seconds. After filling the sprue cup of the shell the shell is covered with refractory material to reduce the rate of temperature drop and to minimize oxidation of the casting by the ambient atmosphere. When the molten metal in the shell has solidified, the ceramic shell is broken off by vibration. The sprues and runners are removed from the castings using a saw. Each casting is ground and polished as required to achieve the final specified dimensions of the castings.

Each casting desirably is heat-treated (solution treated at 1100° C. for four hours) to achieve a good combination of strength and ductility.

Joining of the Front Component to the Rear Component

An exemplary technique for use in joining the front and rear components together is welding. Whereas TIG (tungsten inert gas) welding is satisfactory for welding together clubhead portions made of steel, TIG welding is not favored in the current instance because TIG welding as currently practiced tends to result in the application of a large amount of energy in the region of the weld, which causes excessive melting of surrounding metal and consequent excessive interdiffusion. Excessive interdiffusion can render the weld joint susceptible to cracking and to other mechanical failure modes. A more desirable welding technique is laser welding which provides more concentration of welding energy at the immediate site of the weld, with substantially less energy being applied peripherally to the weld. As a result, compared to TIG welding as currently practiced, laser welding produces a more localized melt in which interdiffusion is more limited, with consequent reduction in material fatigue during subsequent use of the club.

Alternatively to welding, the front and rear components can be joined together by brazing. Laser welding and brazing are commonly practiced by persons or ordinary skill in the art of clubhead manufacturing.

Another alternative method of attaching the front and rear components together is adhesive bonding, which requires the use of an adhesive. The choice of a specific adhesive will depend upon the particular material of the front component and the particular stresses to which the cured adhesive joint must be resistant. Exemplary adhesives include, but are not limited to, two-part epoxy adhesives such as DP420 and DP460 manufactured by 3M (Minneapolis, Minn.), acrylic adhesives such as DP810 manufactured by 3M, any of various urethane adhesives, and film adhesives such as AF-42 manufactured by 3M.

Yet another alternative method of attaching the front and rear components together is mechanical joining by pressing to form, for example, a press fit or lip encasement as commonly practiced by persons of ordinary skill in the art of clubhead manufacturing. In this regard, reference is made for example to U.S. Pat. Nos. 5,697,855 and 6,743,114, which discuss these techniques.

Yet another alternative method of attaching the front and rear components together is mechanical joining by use of mechanical fasteners such as rivets, screws, or analogous fasteners as commonly practiced by persons of ordinary skill in the art of clubhead manufacturing.

Finishing

Before and/or after joining together the front and rear components, any necessary finish machining (cutting, milling, drilling, boring, grinding, smoothing, polishing) and surface treatment (plating, painting, coating) steps are performed as required or desired. The various finish-machining steps are well known to persons of ordinary skill in the relevant art and are not described herein.

After completing any required finish-machining steps, it is desirable to execute a suitable surface treatment of the clubhead. Applying or forming a protective surficial layer on the clubhead is indicated because the low-density alloy will corrode if unprotected. Corrosion is unsightly and can lead to eventual material failure. Plating is especially desired because the resulting surficial "plating" layer protects against corrosion and is strong, durable, relatively inert, and aesthetically pleasing. Exemplary materials for forming a surficial plating layer are Cr, Ni, and Cu. Exemplary techniques for forming the surficial plating layer are electrode plating, electroless plating, physical vapor deposition (PVD), chemical vapor deposition (CVD), ion plating (IP), and ion-beam-enhanced diffusion (IBED).

It is desirable that a plating sublayer (intermediate layer) be applied to the clubhead before applying the surficial plating layer in order to enhance adhesion of the surficial plating layer to the clubhead. This is because most plating layers are brittle and may crack if, for example, an adjustment is made (by bending the hosel of a plated clubhead) of the lie of the clubhead. Exemplary materials for use in forming the plating sublayer are soft nickel, soft copper, and oxides. The plating sublayer is applied in a conventional manner such as any of the methods listed above for forming the surficial plating layer.

Other techniques for applying a protective layer to the clubhead are painting, powder coating, ferritic nitro carburizing, passivation, and other processes that are familiar to persons of ordinary skill in the relevant art.

First Representative Embodiment

Figure 1B:
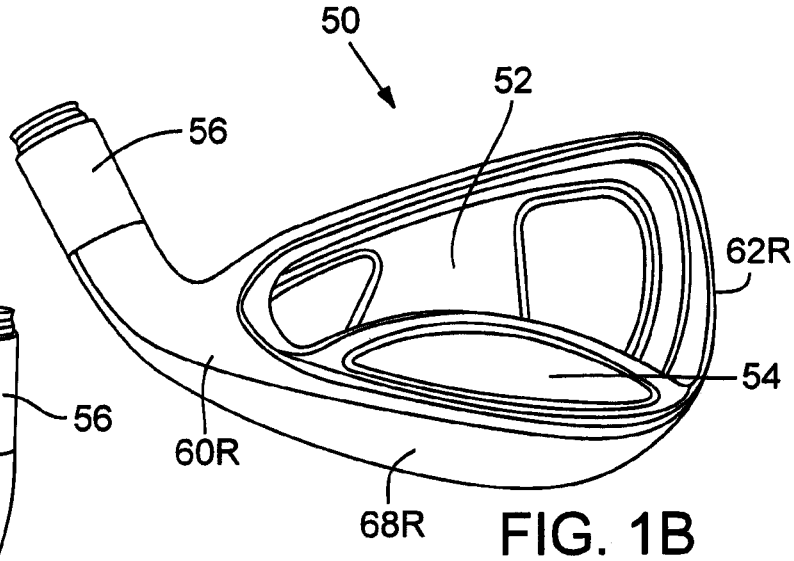
Figure 1C:
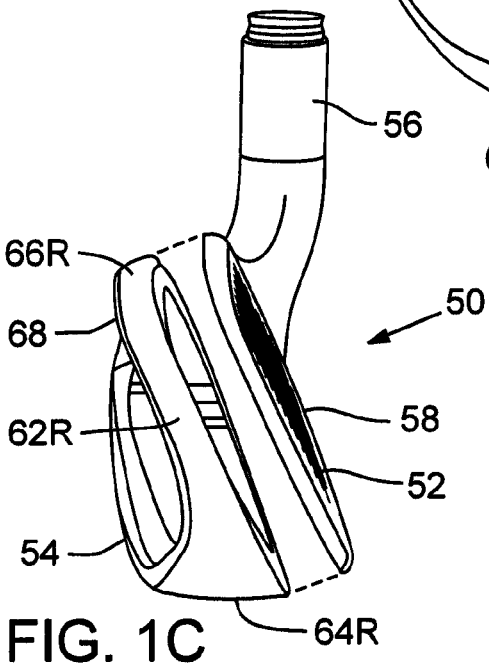

A first representative embodiment of a clubhead 50, as shown in FIGS. 1A-1C, comprises a front component 52 and a rear component 54. The front component 52 includes the hosel 56 and the face 58 of the clubhead (wherein the face includes respective front portions of the heel 60F, toe 62F, sole 64F, and top line 66F). The rear component 54 includes the back 68 as well as respective rear portions of the heel 60R, toe 62R, sole 64R, and top line 66R. The rear component 54 is cast from the low-density alloy, desirably as a unitary member. The front component 52, made of a different material than the rear component 54, is made of any suitable material by any suitable process, and desirably is formed as a unitary member. Hence, whereas the rear component 54 (exclusive of any attachments thereto) has a density in the range of 6.2 to 7.2 g/cm$^3$, more desirably in the range of 6.2 to 6.9 g/cm$^3$, the front component 52 (exclusive of any attachments thereto) can have a density greater than, equal to, or less than the density of the rear component 54. The front component 52 is joined to the rear component 54 by laser welding in this embodiment.

Second Representative Embodiment

Figure 2A:
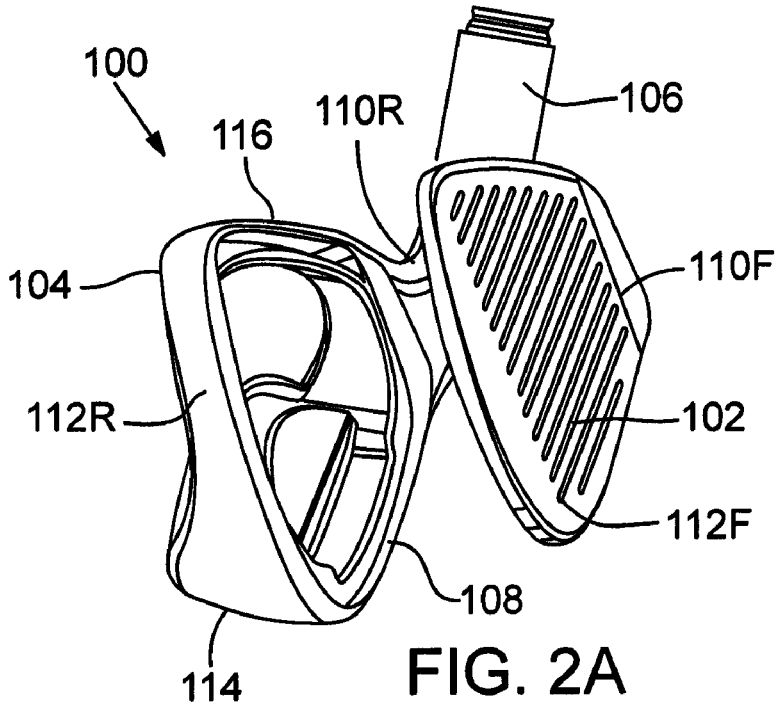
FIGS. 2A-2C are orthogonal views of an iron-type clubhead according to the second representative embodiment and a preferred embodiment.
Figure 2B:
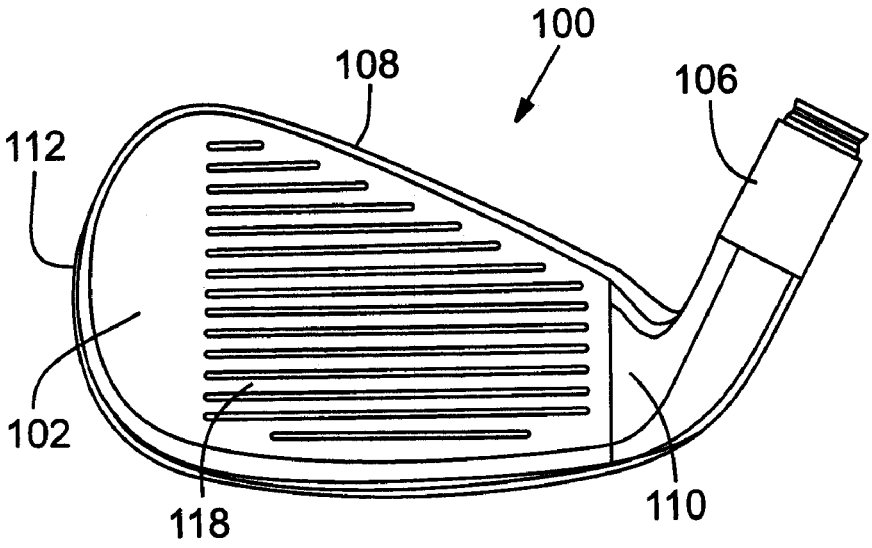
Figure 2C:
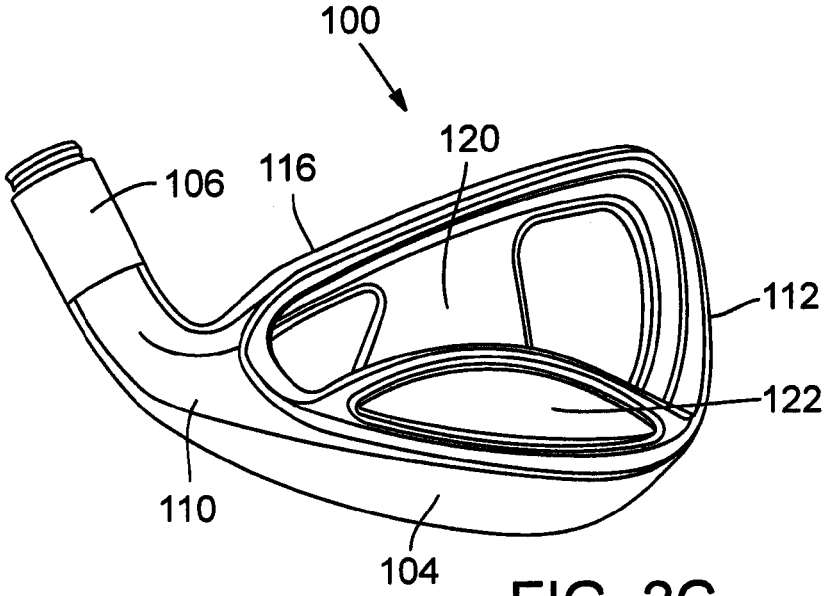
Figure 3:
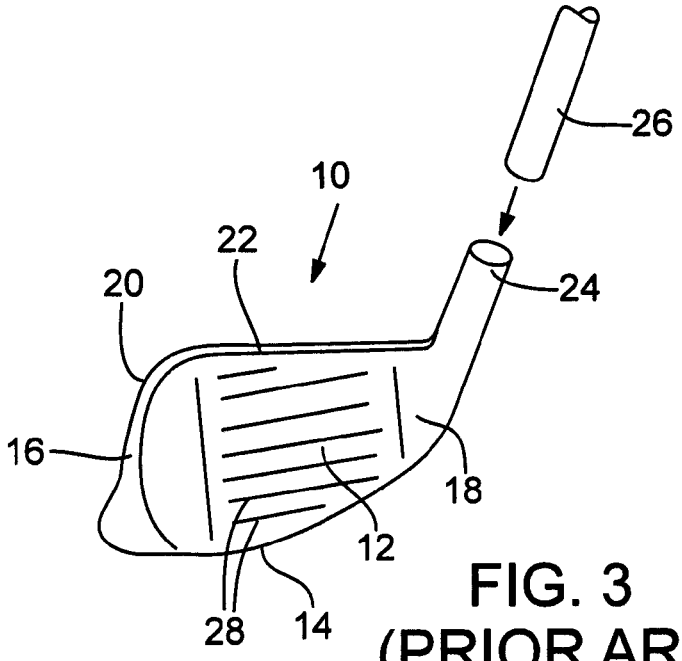
FIG. 3 (PRIOR ART)
FIG. 3 is a perspective view of relevant features of a conventional iron-type clubhead. A portion of the shaft is also shown.

A second representative embodiment of a clubhead 100, as shown in FIGS. 2A-2C, comprises a front component 102 and a rear component 104. The front component 102 is configured as a striking plate adapted to be attached to the rear component 104, such that the front component 102 comprises a substantial portion of the striking face 118. The front component 102 may include respective front portions of the heel 110F and/or toe 112F. The rear component 104 includes the hosel 106 and peripheral regions 108 of the striking face 118 of the clubhead, as well as the sole 114, top line 116, and respective rear portions of the heel 110R and toe 112R. The rear component 104 is cast from the low-density alloy. The front component 102, made of a different material than the rear component 104, is made of any suitable material for a strike plate, such as cast or rolled steel, cast or rolled stainless steel, titanium alloy, composite, and the like. Hence, whereas the rear component 104 (exclusive of any attachments thereto) has a density in the range of 6.2 to 7.2 g/cm$^3$, more desirably in the range of 6.2 to 6.9 g/cm$^3$, the front component 102 (exclusive of any attachments thereto) can have a density greater than (if made of steel), equal to, or less than (if made of titanium or composite) the density of the rear component 104. The front component 102 is attached to the rear component 104 by laser welding in this embodiment.

Various exemplary FeAlMn alloy compositions and corresponding densities are described below in Examples 1-5. The compositions and densities are also summarized in Table 1, below.

EXAMPLE 1

This example is directed to a particular FeAlMn alloy having the following composition (% w/w): 1.15% C, 28.5% Mn, 0.009% P, 0.003% S, 0.21% Si, 3.29% Cr, 0.03% Ni, 0.02% Cu, 9.25% Al, balance Fe. This alloy had a density of approximately 6.40 g/cm$^3$.

EXAMPLE 2

This example is directed to a particular FeAlMn alloy having the following composition (% w/w): 1.05% C, 27.75% Mn, 0.008% P, 0.004% S, 0.35% Si, 3.34% Cr, 0.07% Ni, 0.04% Cu, 8.13% Al, balance Fe. This alloy had a density of approximately 6.51 g/cm$^3$.

EXAMPLE 3

This example is directed to a particular FeAlMn alloy having the following composition (% w/w): 1.17% C, 24.74% Mn, 0.015% P, 0.004% S, 0.93% Si, 7.3% Cr, 0.06% Ni, 0.05% Cu, 8.95% Al, balance Fe. This alloy had a density of approximately 6.33 g/cm$^3$.

EXAMPLE 4

This example is directed to a particular FeAlMn alloy having the following composition (% w/w): 1.12% C, 25.64% Mn, 0.015% P, 0.005% S, 1.42% Si, 6.44% Cr, 0.08% Ni, 0.05% Cu, 7.89% Al, balance Fe. This alloy had a density of approximately 6.38 g/cm$^3$.

EXAMPLE 5

This example is directed to a particular FeAlMn alloy having the following composition (% w/w): 1.02% C, 28.41% Mn, 0.012% P, 0.002% S, 0.8% Si, 6.12% Cr, 0.03% Ni, 0.02% Cu, 9.89% Al, balance Fe. This alloy had a density of approximately 6.26 g/cm$^3$.

TABLE 1

| Example | C % w/w | Mn % w/w | P % w/w | S % w/w | Si % w/w | Cr % w/w | Ni % w/w | Cu % w/w | Al % w/w | Fe % w/w | density g/cm$^3$ |
|---|---|---|---|---|---|---|---|---|---|---|---|
| 1 | 1.15 | 28.5 | 0.009 | 0.03 | 0.21 | 3.29 | 0.03 | 0.02 | 9.25 | balance | 6.40 |
| 2 | 1.05 | 27.75 | 0.008 | 0.004 | 0.35 | 3.34 | 0.07 | 0.04 | 8.13 | balance | 6.51 |
| 3 | 1.17 | 24.74 | 0.015 | 0.004 | 0.93 | 7.3 | 0.06 | 0.05 | 8.95 | balance | 6.33 |
| 4 | 1.12 | 25.64 | 0.015 | 0.005 | 1.42 | 6.44 | 0.08 | 0.05 | 7.889 | balance | 6.38 |
| 5 | 1.02 | 28.41 | 0.012 | 0.002 | 0.8 | 6.12 | 0.03 | 0.02 | 9.89 | balance | 6.26 |

Preferred Embodiment

A preferred embodiment pertains to a set of respective clubheads for irons and wedges, wherein each clubhead has a configuration as described above with respect to the second representative embodiment shown in FIGS. 2A-2C. The rear component was configured as a cavity-back type iron clubhead, similar to the "rac CGB" iron manufactured by Taylor Made Golf. Referencing FIGS. 2A-2C, the depicted clubhead 100 comprises a front component 102 and a rear component 104. The rear component 104 includes the hosel 106 and peripheral regions 108 of the striking face 118 of the clubhead, as well as the sole 114, top line 116, and rear portions of the heel 110R and toe 112R. The front component 102 is made of cast, rolled, or forged steel and is configured as a striking plate adapted to be attached to the rear component 104. The rear component 104 is made of the FeAlMn alloy and includes most of the heel 110 and sole 114. The rear component 104 is joined to the front component 102 as shown in FIG. 2C. FIG. 2C depicts the rear surface 120 of the front component 102; hence, the hollow or "cavity" aspect of the back of the clubhead is evident. The sole bar portion 122 can be used for mounting weighting elements for CG manipulation, or for mounting any of various other bodies for use, for example, in manipulating the feel of the clubhead.

In Table 2, below, the various terms have the following definitions: "Nominal clubhead mass" is the nominal manufacturing mass for each of the indicated types of irons, and is the sum of the front component mass, the rear component mass, and any weighting elements or damping inserts attached to the front or rear components. "Front component volume" in this example is the volume of the front component that is joined to the rear component. "Rear component volume" is the volume of the rear component cast of the low-density alloy. "Front component density" is the density of the material used for forming the front component. "Rear component density" is the density of low-density alloy material used to form the rear component. "Front component mass" is the front component volume times the front component density. "Rear component mass" is the rear component volume times the rear component density. "Discretionary weight" is the nominal clubhead mass less the rear component mass and less the front component mass. I.e., the discretionary weight is the mass of the clubhead that does not contribute to the structural integrity of the clubhead and that typically is "taken up" by weighting elements (e.g., plugs of tungsten or the like) or damping inserts. "% front component mass of nominal clubhead mass" is the front component mass divided by the nominal clubhead mass. "% rear component mass of nominal clubhead mass" is the rear component mass divided by the nominal clubhead mass.

TABLE 2

| Description | 3-iron | 4-iron | 5-iron | 6-iron | 7-iron | 8-iron | 9-iron | pitching wedge | gap wedge | sand wedge |
|---|---|---|---|---|---|---|---|---|---|---|
| nominal clubhead mass, total (g) | 241.3 | 247 | 252.9 | 259.4 | 265.9 | 273.1 | 279.3 | 284.3 | 285.1 | 293.4 |
| front component volume (cm$^3$) | 7.70 | 7.76 | 7.88 | 8.05 | 8.08 | 8.24 | 8.34 | 8.33 | 8.69 | 8.37 |
| rear component volume (cm$^3$) | 19.81 | 20.55 | 20.92 | 21.70 | 22.50 | 23.09 | 23.91 | 24.63 | 24.24 | 25.62 |
| front component density (g/cm$^3$) | 7.7 | 7.7 | 7.7 | 7.7 | 7.7 | 7.7 | 7.7 | 7.7 | 7.7 | 7.7 |
| rear component density (g/cm$^3$) | 6.2-7.2 | 6.2-7.2 | 6.2-7.2 | 6.2-7.2 | 6.2-7.2 | 6.2-7.2 | 6.2-7.2 | 6.2-7.2 | 6.2-7.2 | 6.2-7.2 |
| front component mass (g) | 59.3 | 59.8 | 60.7 | 62.0 | 62.2 | 63.4 | 64.2 | 64.1 | 66.9 | 64.4 |
| rear component mass (g) | 122.8-142.6 | 127.4-148.0 | 129.7-150.6 | 134.5-156.2 | 139.5-162.0 | 143.2-166.2 | 148.2-172.2 | 152.7-177.3 | 150.3-174.5 | 158.8-184.5 |

TABLE 2-continued

| Description | 3-iron | 4-iron | 5-iron | 6-iron | 7-iron | 8-iron | 9-iron | pitching wedge | gap wedge | sand wedge |
|---|---|---|---|---|---|---|---|---|---|---|
| discretionary weight (g) | 39.4-59.2 | 39.3-59.8 | 41.6-62.5 | 41.2-62.9 | 41.7-64.2 | 43.4-66.5 | 42.9-66.8 | 42.8-67.5 | 43.7-67.9 | 44.5-70.1 |
| % front component mass of nominal clubhead mass | 24.6 | 24.2 | 24.0 | 23.9 | 23.4 | 23.2 | 23.0 | 22.6 | 23.5 | 22.0 |
| % rear component mass of nominal clubhead mass | 50.9-59.1 | 51.6-59.9 | 51.3-59.6 | 51.9-60.2 | 52.5-60.9 | 52.4-60.9 | 53.1-61.6 | 53.7-62.4 | 52.7-61.2 | 54.1-62.9 |

As shown in Table 2, the percent front component mass of nominal clubhead mass for a particular preferred clubhead may range from about 22.0% to about 24.6%, where the percent front component mass of nominal clubhead mass is higher for long irons and lower for short irons and wedges within a set of irons. In other embodiments, the percent front component mass of nominal clubhead mass may range from about 19% to about 28%. Similarly, the percent rear component mass of nominal clubhead mass for a particular preferred clubhead may range from about 50.9% to about 62.9%, where the percent rear component mass of nominal clubhead mass is lower for long irons and higher for short irons within a set of irons. In other embodiments, the percent rear component mass of nominal clubhead mass may range from about 45% to about 68%.

The described embodiments are for illustrative purposes only and are not to be regarded as limiting in any way. The embodiments described herein can be subject to any of various modifications and changes without departing from the spirit or scope of the claims below. Included within the scope of the following claims are all such modifications that come within the spirit and scope of said claims.

What is claimed is:

1. A clubhead for an iron-type golf club, the clubhead comprising:

a back, a sole, a top line, a heel, a toe, and a hosel;

a rear component made at least partially of a FeAlMn alloy having a density in a range of 6.2 to 7.2 g/cm$^3$, the rear component including the back and at least a respective portion of each of the sole, the top line, and the toe; and a front component affixed to the rear component so as collectively to define an iron-type clubhead, the front component comprising at least a portion of a face of the clubhead and made of a material other than the FeAlMn alloy used to make the rear component, the front component including at least the hosel and a portion of the heel.

2. The clubhead of claim 1, wherein the FeAlMn alloy contains (by weight) maximally 1% C, 27-32% Mn, 6-10% Al, 3-5% Cr, maximally 1% Si, and the balance being Fe.

3. The clubhead of claim 2, wherein the density of the alloy is in the range of 6.2 to 6.9 g/cm$^3$.

4. The clubhead of claim 1, wherein the front component consists essentially of a striking plate affixed to the rear component.

5. The clubhead of claim 4, wherein the front component is made of a metal selected from the group consisting of titanium alloys and steels.

6. The clubhead of claim 5, wherein the steels are selected from the group consisting of carbon steels, Cr—Mo steels, Ni—Cr—Mo steels, austenitic stainless steels, ferritic stainless steels, martensitic stainless steels, and PH alloys.

7. The clubhead of claim 1, wherein at least a portion of the front component is made of a material having a density in a range of 7.7 to 7.9 g/cm$^3$.

8. The clubhead of claim 7, wherein the front component is made of a material selected from the group consisting of titanium alloys and steels.

9. The clubhead of claim 8, wherein the steel is selected from the group consisting of carbon steels, Cr—Mo steels, Ni—Cr—Mo steels, austenitic stainless steels, ferritic stainless steels, martensitic stainless steels, and PH alloys.

10. The clubhead of claim 1, wherein the rear component is a casting.

11. The clubhead of claim 1, wherein at least a portion of the front component is forged, rolled, or a casting, or a combination thereof.

12. The clubhead of claim 1, wherein:

the rear component includes weighting elements affixed thereto; and at least one of the weighting elements has a density greater than the density of the FeAlMn alloy.

13. The clubhead of claim 1, wherein:

the front component includes weighting elements affixed thereto; and at least one of the weighting elements has a density greater than the density of the FeAlMn alloy.

14. The clubhead of claim 1, wherein at least a portion of the front component is comprised of a material selected from the group consisting of metals, composites, polymers, ceramics, and mixtures and combinations thereof.

15. The clubhead of claim 14, wherein the portion is made of a metal selected from the group consisting of steels, titanium alloys, aluminum alloys, magnesium alloys, copper alloys, nickel alloys, amorphous alloys, and combinations thereof.

16. The clubhead of claim 14, wherein the portion is made of a composite selected from the group consisting of glass-fiber-reinforced polymers, carbon-fiber-reinforced polymers, ceramic-matrix composites, metal-matrix composites, natural composites, and combinations thereof.

17. The clubhead of claim 14, wherein the portion is made of a polymer selected from the group consisting of thermoplastics, thermosets, copolymers, elastomers, and combinations thereof.

18. The clubhead of claim 17, wherein the portion is made of a thermoplastic selected from the group consisting of polyethylene, polypropylene, polystyrene, acrylic, PVC, ABS, polycarbonate, polyurethane, polyphenylene oxide, polyphenylene sulfide, nylon, engineering thermoplastics, and combinations thereof.

19. The clubhead of claim 17, wherein the portion is made of a thermoset selected from the group consisting of polyurethanes, epoxies, polyesters, and combinations thereof.

20. The clubhead of claim 14, wherein:

the portion is made of a ceramic selected from the group consisting of oxides, carbides, and nitrides, and combinations thereof.

21. The clubhead of claim 20, wherein the oxides include any one or more of titanium oxide, aluminum oxide, magnesium oxide, and silicon dioxide.

22. The clubhead of claim 20, wherein the carbides include any one or more of titanium carbide, tungsten carbide, silicon carbide, and boron hydride.

23. The clubhead of claim 20, wherein the nitride is silicon nitride.

24. An iron-type clubhead, comprising:

a rear component, a front component, a back, a hosel, and a face;

the rear component including the back and hosel and being made at least partially of a FeAlMn alloy having a density in a range of 6.2 to 7.2 g/cm$^3$ and containing (by weight) maximally 1 % C, 27-32 % Mn, 6-10 % Al, 3-5 % Cr, maximally 1 % Si, and the balance being Fe; and the front component being affixed to the rear component so as collectively to define an iron-type clubhead, the front component having a mass comprising about 19-28% of a total mass of the clubhead and comprising at least a portion of the face, at least a portion of the front component being made of a material having a density in a range of 7.7 to 7.9 g/cm$^3$ and being selected from the group consisting of titanium alloys, carbon steels, Cr—Mo steels, Ni—Cr—Mo steels, austenitic stainless steels, ferritic stainless steels, martensitic stainless steels, and PH alloys.

25. A clubhead for an iron-type golf club, the clubhead comprising:

a rear component made at least partially of a FeAlMn alloy having a density in a range of 6.2 to 7.2 g/cm$^3$; and a front component affixed to the rear component so as collectively to define an iron-type clubhead, the front component comprising at least a portion of a face of the clubhead and made of a material other than the FeAlMn alloy used to make the rear component;

wherein at least a portion of the front component is comprised of a composite selected from the group consisting of glass-fiber-reinforced polymers, carbon-fiber-reinforced polymers, ceramic-matrix composites, metal-matrix composites, natural composites, and combinations thereof.

26. A clubhead for an iron-type golf club, the clubhead comprising:

a rear component made at least partially of a FeAlMn alloy having a density in a range of 6.2 to 7.2 g/cm$^3$; and a front component affixed to the rear component so as collectively to define an iron-type clubhead, the front component comprising at least a portion of a face of the clubhead and made of a material other than the FeAlMn alloy used to make the rear component;

wherein at least a portion of the front component is made of a polymer selected from the group consisting of thermoplastics, thermosets, copolymers, elastomers, and combinations thereof.

27. The clubhead of claim 26, wherein the thermoplastic is selected from the group consisting of polyethylene, polypropylene, polystyrene, acrylic, PVC, ABS, polycarbonate, polyurethane, polyphenylene oxide, polyphenylene sulfide, nylon, engineering thermoplastics, and combinations thereof

28. The clubhead of claim 26, wherein the thermo set is selected from the group consisting of polyurethanes, epoxies, polyesters, and combinations thereof.

* * * * *